US007896079B2

(12) United States Patent
Dyer et al.

(10) Patent No.: US 7,896,079 B2
(45) Date of Patent: Mar. 1, 2011

(54) SYSTEM AND METHOD FOR INJECTION INTO A WELL ZONE

(75) Inventors: Stephen Dyer, Al Khobar (SA); Donald W. Ross, Houston, TX (US); Dean Ellison, Midland, TX (US); Brian Scott, Aberdeen (GB); Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 186 days.

(21) Appl. No.: 12/038,061

(22) Filed: Feb. 27, 2008

(65) Prior Publication Data

US 2009/0211755 A1 Aug. 27, 2009

(51) Int. Cl.
*E21B 43/25* (2006.01)
*F04B 35/04* (2006.01)

(52) U.S. Cl. ..... 166/306; 417/423.3; 417/424.2; 166/66.4; 166/105

(58) Field of Classification Search ..... 166/306, 166/105, 68, 66.4, 313, 265; 417/423.3, 417/424.2
See application file for complete search history.

(56) References Cited

U.S. PATENT DOCUMENTS 2,214,064 A * 9/1940 Niles ..... 166/54
2,889,880 A * 6/1959 Hughes ..... 166/313
3,199,592 A * 8/1965 Jacob ..... 166/306
3,363,692 A * 1/1968 Bishop ..... 166/306
4,133,384 A * 1/1979 Allen et al. ..... 166/402
4,241,787 A * 12/1980 Price ..... 166/105
5,979,559 A * 11/1999 Kennedy ..... 166/369
6,196,312 B1 * 3/2001 Collins et al. ..... 166/265
6,318,469 B1 * 11/2001 Patel ..... 166/305.1
6,415,864 B1 * 7/2002 Ramakrishnan et al. ..... 166/250.03
6,457,522 B1 * 10/2002 Bangash et al. ..... 166/267
6,533,039 B2 3/2003 Rivas
6,842,700 B2 1/2005 Poe
7,216,703 B2 5/2007 Smith
7,224,080 B2 5/2007 Smedstad
7,258,164 B2 8/2007 Rezgui
7,261,162 B2 8/2007 Deans
7,326,034 B2 2/2008 Sheth
7,326,037 B2 2/2008 Eslinger
2002/0050361 A1 * 5/2002 Shaw et al. ..... 166/380
2004/0173350 A1 * 9/2004 Wetzel et al. ..... 166/253.1
2006/0006656 A1 1/2006 Smedstad
2006/0086498 A1 4/2006 Wetzel
2006/0162934 A1 7/2006 Shepler
2007/0027245 A1 2/2007 Vaidya
2007/0059166 A1 3/2007 Sheth
2007/0074872 A1 4/2007 Du
2007/0110593 A1 5/2007 Sheth
2007/0116560 A1 5/2007 Eslinger (Continued)

*Primary Examiner*—Kenneth Thompson
*Assistant Examiner*—Catherine Loikith

(57) ABSTRACT

A technique facilitates a water flood, e.g. dump flood, operation. A standard electric submersible pumping system is deployed in a wellbore to draw water from an aquifer or water source zone along the wellbore. A shroud and a crossover port are used in combination with the submersible pumping system to redirect pumped water downwardly along an isolated flow path. The downward flow of pumped water is directed along the wellbore and injected into a desired, injection zone to facilitate recovery of oil or to perform other types of water flood operations.

19 Claims, 3 Drawing Sheets

U.S. PATENT DOCUMENTS

2007/0142547 A1 6/2007 Vaidya
2007/0144738 A1 6/2007 Sugiyama
2007/0199696 A1 8/2007 Walford
2007/0227727 A1 10/2007 Patel
2007/0235185 A1 10/2007 Patel
2007/0295504 A1 12/2007 Patel
2008/0093084 A1* 4/2008 Knight et al. ..... 166/369
2009/0242197 A1* 10/2009 Hackworth et al. .... 166/250.01

* cited by examiner

SYSTEM AND METHOD FOR INJECTION INTO A WELL ZONE

BACKGROUND

Water flood projects are a common approach to enhance oil recovery. Water typically is obtained from an aquifer or from the sea. The water is transported to an injection well site by surface facilities including pumps, filters, water treatment equipment and flow lines. At the injection well site, the water is injected into the desired formation that is to be water flooded.

In some environments, the reservoir to be treated by water flooding is positioned below a suitable source of water in the form of a subterranean aquifer. Several techniques have been employed to "dump flood" water from the upper aquifer or/well zone into a lower interval or well zone at a location designed to enhance oil recovery from an oil reservoir. Various techniques have been used to dump flood water from one well zone into another well zone. For example, electric submersible pumping systems have been inverted and installed below the upper zone interval. Water from the aquifer is drawn into the pump intake of the electric submersible pumping system and discharged downwardly into tubing strung into a lower zone packer, thus injecting water into the desired, lower interval. Locating the inverted electric submersible pumping system below the upper interval can pose additional risk from solids production settling onto the pumping system, which can hinder retrieval of the pumping system.

Attempts have been made to use a variety of other techniques and equipment for dump flooding water into a lower well zone. For example, systems have been designed to draw fluid to a surface location and to pump fluid back downhole to the desired well zone. Additionally, rod pumps have been employed, and electric submersible pumping systems have been proposed for combination with relatively complex Y-blocks for redirecting flow to the lower well zone. However, each of these approaches suffers from various drawbacks, including lower efficiency, increased space requirements, reduced injection rates, added complexity, and other drawbacks.

Other proposals have been made to utilize the natural reservoir pressure for dump flooding a lower well zone. If, for example, the natural pressure in the aquifer is higher than the pressure of the injection zone, the higher pressure can be used to drive water downwardly into the desired, injection zone. However, natural dump flooded wells can be difficult to control. In some applications, restrictors or chokes are installed by intervention or as part of the completion, but such approaches rely heavily on the specific environmental conditions and also increase the difficulty of controlling the injection of water to enhance oil recovery.

SUMMARY

In general, the present invention provides a system and method for improving a water flood, e.g. dump flood, operation. A standard or non-inverted electric submersible pumping system is deployed in a wellbore to draw water from a water source zone along the wellbore. A shroud and a crossover port are employed to redirect a flow of the water downwardly along an isolated flow path. The controlled, downward flow of water is directed along the wellbore until the water is injected into a desired, injection zone to facilitate, for example, oil recovery.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for injecting a fluid, such as water, into a subterranean well zone. The injection technique can be used to enhance oil recovery from a given reservoir. Generally, the system utilizes a standard or non-inverted electric submersible pumping system which is deployed in a wellbore. The submersible pumping system is positioned to draw fluid from one well zone and to inject that fluid into another well zone. In one injection application, the submersible pumping system draws water from a water source zone and pumps the water to an injection zone. For example, in an oil recovery operation, the injection zone is selected to facilitate recovery of oil from an oil containing reservoir. In some applications, the injection zone lies directly below the oil containing zone or reservoir.

The injection system and methodology reduces the surface facilities, pumps, pipelines, and other equipment required in conventional oil recovery operations. Additionally, the system is less subjectable to the effects of space and environmental restrictions while reducing capital expenditure requirements. Furthermore, the injection system enables high injection rates for a variety of dump flood applications. The arrangement of equipment also facilitates easy retrieval of the non-inverted electric submersible pumping system while enabling zone isolation when retrieving the pumping system.

In some applications, the system and methodology incorporate monitoring devices at selected downhole locations, e.g. across the water source zone and the injection zone. The monitoring enables, for example, identification and optimization of well efficiency and sweep. A variety of chemicals also can be combined with the water pumped from the water source zone to the injection zone, and this injection of chemicals enables stimulation procedures or water treatment injections during operation of the electric submersible pumping system. Additionally, the injection system can be formed as a concentric design which facilitates running and retrieval operations. Keeping the electric submersible pumping system maintained in a standard (non-inverted) operating configuration is consistent with standard pump installations and therefore the associated reliability and installation experience are well practiced.

Figure 1:
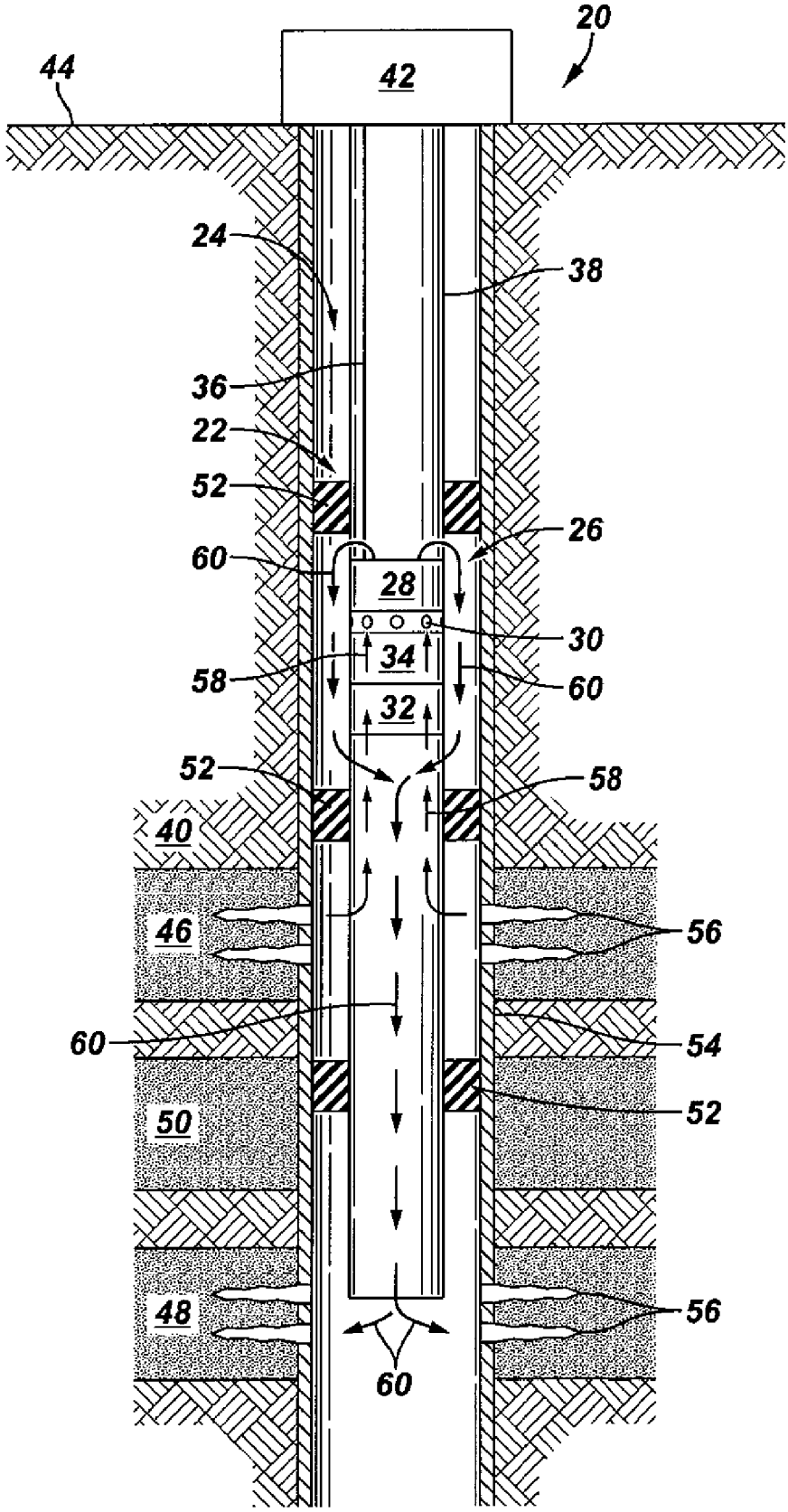
FIG. 1 is a schematic front elevation view of a system for injecting fluid into a well zone, according to an embodiment of the present invention.

Referring generally to FIG. 1, one embodiment of a system 20 for injecting water into a desired well zone is illustrated. In this embodiment, a completion system 22 is deployed in a wellbore 24 and comprises a non-inverted electric submersible pumping system 26. The electric submersible pumping system 26 is non-inverted in the sense that it is arranged in a standard orientation within wellbore 24. For example, the pumping system 26 comprises a submersible pump 28 arranged above a pump intake 30. The submersible pump 28 also is positioned above a submersible motor 32 which is coupled to a motor protector 34. Power is provided to submersible motor 32 via an appropriate power cable 36 routed downhole.

The non-inverted electric submersible pumping system 26 is deployed into wellbore 24 on a suitable conveyance 38. Conveyance 38 may comprise a cable-type conveyance, production tubing, coiled tubing, or other suitable conveyance. In many applications, the submersible pumping system 26 is conveyed downhole on production tubing or coiled tubing. Conveyance 38 is used to move submersible pumping system 26 to a desired location in wellbore 24. In the example illustrated, wellbore 24 is a generally vertical wellbore that extends downward into a subterranean formation 40 from a wellhead 42 positioned at a surface location 44. However, wellbore 24 can be a deviated wellbore or have deviated sections. Additionally, submersible pumping system 26 can be arranged to deliver water into a lateral wellbore or into a variety of well zones in different locations or orientations than those illustrated.

Completion system 22 and non-inverted electric submersible pumping system 26 are arranged to draw fluid, e.g. water, from a source zone 46, and to route the water to an injection zone 48. In the embodiment illustrated, the injection zone 48 is located below the water source zone 46. In other applications, however, water could be drawn from water source zone 46 and injected into an injection zone located above water source zone 46. Additionally, the water can be injected into a variety of zones at various locations relative to, for example, an oil reservoir zone. In the example illustrated, injection zone 48 is located directly beneath an oil reservoir zone 50.

The various well zones can be isolated from each other along wellbore 24 by isolation devices, such as packers 52, positioned at various locations along the wellbore. By way of example, packers 52 can be expanded against a surrounding well casing 54 having perforations 56 located at the desired source zone and injection zone. In the embodiment illustrated, a packer 52 is used to isolate water source zone 46 from injection zone 48, and another packer is located between water source zone 46 and submersible pumping system 26. In at least some applications, wellbore 24 also can be isolated above the submersible pumping system 26 by a packer, such as the uppermost packer 52 illustrated in FIG. 1.

During operation of non-inverted electric submersible pumping system 26, fluid is drawn from source zone 46 to pump intake 30 of submersible pumping system 26. For example, water can be drawn upwardly along a first isolated fluid flow path, as represented by arrows 58. As the water flows into pump intake 30, submersible pump 28 pumps the water and discharges the water into a second isolated fluid flow path, as represented by arrows 60. The second isolated fluid flow path routes the discharged water downwardly past packers 52 to injection zone 48, where the water is injected into the injection zone.

The electric submersible pumping system 26 is used to generate sufficient energy to inject the required amount of water into the injection zone. As described in greater detail below, the system 20 allows for downhole monitoring and control over each of the well zones. The system 20 also provides for simultaneous injection of acid or other treatment chemicals, isolation of individual zones during pump change out, sand control for one or both of the water source and injection zones, and use in not only vertical wells but also multi-lateral well and deviated well applications, including horizontal well applications. In the embodiment illustrated in FIG. 1, system 20 is deployed in a cased wellbore, but the system also can be utilized in open hole wells.

Figure 2:
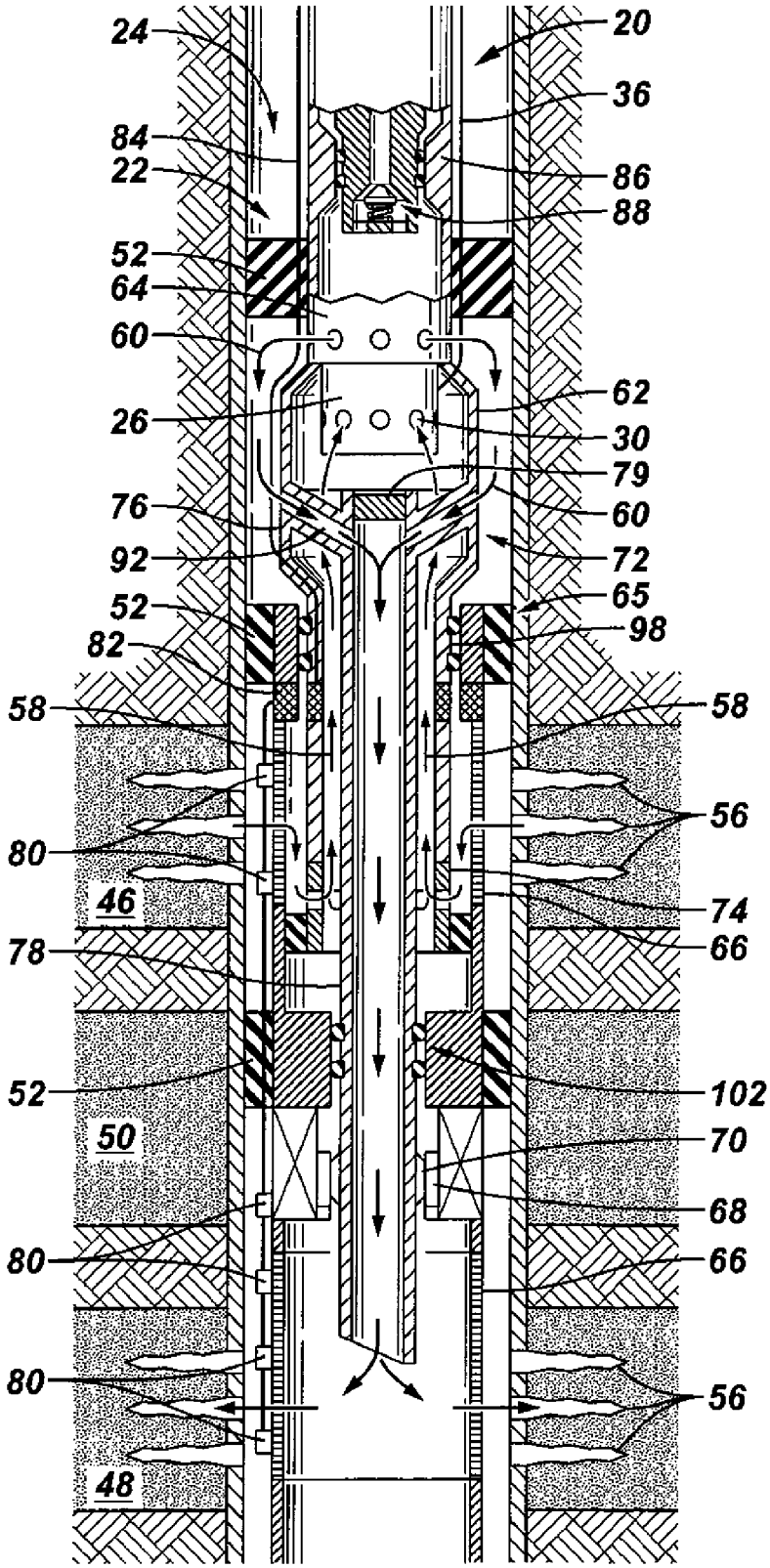
FIG. 2 is an illustration of a detailed example of the injection system illustrated in FIG. 1, according to an embodiment of the present invention.

One example of an injection system 20 that can be used in many of these applications is illustrated in FIG. 2. In this embodiment, electric submersible pumping system 26 is oriented in the standard or non-inverted configuration, and a shroud 62 is positioned around the electric submersible pumping system 26. The shroud 62 defines, at least in part, the isolated fluid flow paths 58 and 60. For example, fluid from source zone 46 flows into intake 30 of submersible pumping system 26 along an interior of shroud 62 between submersible pumping system 26 and shroud 62. The fluid is discharged by submersible pumping system 26 through, for example, a ported sub 64 positioned above the shroud 62 so that the discharged fluid flows along fluid flow path 60 in a downward direction along the exterior of shroud 62. In the example illustrated, a portion of fluid flow path 60 is disposed between shroud 62 and the surrounding wellbore wall, e.g. surrounding well casing.

In this example, the source zone 46 is a water source zone which can be located at, for example, an upper interval or a bottom interval of the well. In the specific example illustrated, the water source zone 46 is an upper zone/interval and provides the source water for injection into injection zone 48 located below the water source zone 46. The water source zone may be chosen based on a variety of factors, including proximity to the injection zone 48, water quality, and reservoir quality. The source zone can be open or conventionally cased and perforated in a vertical, deviated or horizontal well. In some applications, the source zone can be accessed via a lateral leg extending from a main wellbore. As illustrated, the injection zone 48 can be located below a hydrocarbon bearing zone/reservoir which requires, for example, additional pressure support to compensate for field hydrocarbon production. The injection zone also can be open or conventionally cased and perforated in a vertical, deviated or horizontal well; or the zone can be accessed via a lateral leg from a main wellbore.

The packers 52 are used to isolate various zones along wellbore 24 and may include seal bore packers located between the aquifer or source zone 46 and the injection zone 48 as well as between the upper zone, e.g. the source zone 46, and the shrouded submersible pumping system 26. In many applications, the two seal bore packers are run and set separately as part of a sandface completion 65, followed by installation of the electric submersible pumping system 26. The packers 52 also may comprise an optional production packer placed above the ported discharge sub 64. Use of a production packer above the electric submersible pumping system 26 and ported discharge sub 64 prevents annular pressure from reaching the surface during operation of the submersible pumping system.

As illustrated, system 20 also may utilize sand control mechanisms 66 positioned in wellbore 24 at water source zone 46 and/or injection zone 48. By way of example, the sand control mechanisms 66 may comprise sand exclusion screens or gravel packs. In many applications, a sand control mechanism 66 is used at the water source zone because the formation can be relatively loose, resulting in the production of sand. Sand can be detrimental by reducing the run life of the electric submersible pumping system and by increasing the difficulty of performing electric submersible pumping system work-over operations.

System 20 also may incorporate a flow isolation valve 68 positioned at the lower zone, e.g. injection zone 48. By way of example, isolation valve 68 may be a mechanically operated isolation valve run to the lower zone to isolate the lower zone during pulling and re-running of the electric submersible pumping system assembly. The isolation valve 68 protects the lower well zone from damaging kill fluids. Isolation valve 68 may be operated by a shifting tool 70 located at the bottom of an electric submersible pumping system string 72. The shifting tool 70 opens isolation valve 68 when the electric submersible pumping system string 72 is run in hole, and closes isolation valve 68 when the string 72 is pulled out of hole.

Additionally, a sliding sleeve 74 can be used to provide protection for well zone 46 during run in and pull out operations. In the embodiment illustrated, sliding sleeve 74 is a ported sliding sleeve that selectively enables flow from source zone 46 to electric submersible pumping system 26 during an injection operation. A variety of sliding sleeves 74 can be used to selectively open or close access to the upper well zone. By way of example, sliding sleeve 74 is a mechanical sleeve operated by a shifting tool placed, for example, on the bottom of a crossover port 76. The sliding sleeve 74 is opened when electric submersible pumping system string 72 is run in hole and closed when string 72 is pulled out of hole.

The crossover port 76 directs the flow of fluid that is drawn from source zone 46 and subsequently delivered to injection zone 48. For example, crossover port 76 receives fluid from source zone 46 and directs the flow of fluid to the interior of shroud 62 between shroud 62 and electric submersible pumping system 26. The crossover port 76 also receives the fluid that flows downwardly along an exterior of shroud 62 after being discharged through ported discharge sub 64. The crossover port 76 causes the downwardly flowing fluid to "crossover" from the annulus region into an isolation tubing 78 which transports the flowing fluid down to the injection zone 48. The isolation tubing 78 is designed to seal with the lower packer 52, and a plug 79 is used to block any upward flow through the top of isolation tubing 78. In this embodiment, it also should be noted that fluid flowing upwardly from water source zone 46 flows into ported sliding sleeve 74 and up through an annulus created along an exterior of the isolation tubing 78.

Before, during and/or after the injection operation, a variety of sensors can be used to monitor well conditions and operational parameters. For example, a plurality of sensors 80 can be deployed along wellbore 24. In some embodiments, sensors 80 can be deployed along source zone 46 and/or along injection zone 48, as illustrated in FIG. 2. The sensors 80 may be formed as a sensor array to detect the desired well conditions and parameters. For example, sensors 80 may comprise pressure sensors, temperature sensors, pH sensors, flow sensors and other sensors related to the injection operation. Data from sensors 80 is used to evaluate and control various aspects of the injection operation.

In one embodiment, sensors 80 are connected to an inductive flux coupler 82 which provides power and communication signals between the upper electric submersible pumping system completion 22, comprising electric submersible pumping string 72, and the lower sandface completion 65. This enables sensors 80 to power up and transmit signals to a surface location via a permanent downhole cable 84 and a downhole electronic interface comprising the inductive coupler 82. The permanent downhole cable 84 or other suitable control line can be run from the surface along with the electric submersible pumping system 26.

In the embodiment illustrated in FIG. 2, chemicals, e.g. acid or other treatment chemicals, can be injected into the flow of fluid from source zone 46 to injection zone 48 during operation of submersible pumping system 26. The chemicals may be injected through a nipple profile 86 and into the flow of fluid discharged from ported discharge sub 64. Injection of chemicals through nipple profile 86 and into the discharge flow of fluid avoids introducing the chemicals into the interior of electric submersible pumping system 26. The chemicals are then carried by the flow of fluid down through isolation tubing 78 and injected into injection zone 48. The nipple profile 86 also may comprise a standing valve or check valve 88 that ensures the flow of chemicals is in a downward direction. Check valve 88 can further be arranged to enable tubing pressure testing. The chemicals can be run downhole through the conveyance 38 or through dedicated chemical injection lines and may comprise water treatment chemicals, corrosion treatment chemicals, stimulation chemicals, enhanced oil recovery chemicals and other suitable chemicals.

Figure 3:
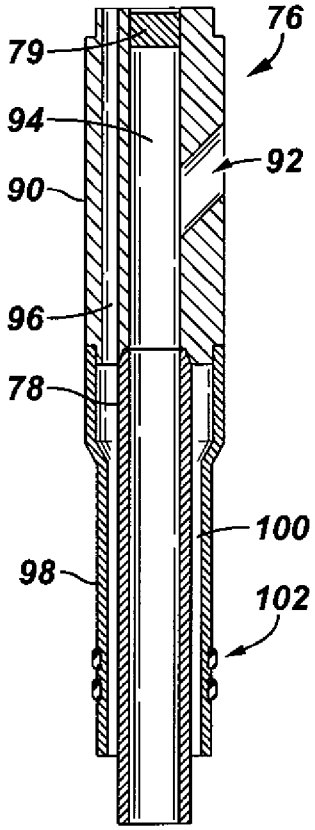
FIG. 3 is a cross-sectional view of a crossover port that can be used with the system illustrated in FIG. 2, according to an embodiment of the present invention.

Referring generally to FIG. 3, one embodiment of crossover port 76 is illustrated. In this embodiment, crossover port 76 is constructed as an assembly including isolation tubing 78. Isolation tubing 78 extends downwardly from a crossover port body 90 having at least one crossover flow port 92 that extends from the surrounding annulus to an internal flow passage 94. Internal flow passage 94 is in fluid communication with isolation tubing 78 and is blocked on top by plug 79. The crossover port body 90 also comprises one or more annular flow ports 96 extending from the bottom to the top of the crossover port body 90. Annular flow ports 96 are part of fluid flow path 58 and extend through the crossover port body to accommodate fluid flow to electric submersible pumping system 26. An outer housing 98 extends downwardly from crossover port body 90 and surrounds at least a portion of isolation tubing 78 to create an annular flow area 100. The annular flow area 100 also forms a portion of fluid flow path 58 for conducting fluid from source zone 46 up to annular flow ports 96. Outer housing 98 also may comprise a seal assembly 102 positioned to form a sealing engagement with the lower packer as illustrated in FIG. 2.

Depending on the specific arrangement of components and the environment in which system 20 is utilized, the system can be deployed according to a variety of procedures. In one example, deployment and use of injection system 20 comprises initially drilling wellbore 24, deploying well casing 54, and perforating the well casing to form perforations 56. The sandface completion 65 is then installed in a single trip downhole or, alternatively, in two separate stages. The sandface completion 65 comprises the two lower packers 52 which may be hydraulically set packers or swell packers. The sensors 80 also can be formed as a suitable array or bridle and deployed with the sandface completion 65. In at least some applications, a gravel pack is then formed at source zone 46 and/or injection zone 48.

Once the gravel pack or gravel packs are placed and the gravel pack proppant is circulated out of hole, a service tool is used to close flow isolation valve 68. The service tool also can be adapted to close the ported sliding sleeve 74 so that both formation intervals, i.e. injection zone 48 and source zone 46, are isolated.

The completion 22, with electric submersible pumping system 26 and shroud 62, is then run downhole for engagement with the sandface assembly 65. The isolation valve shifting tool 70 is attached at the lower end of the string. For example, the shifting tool 70 can be attached to the bottom of isolation tubing 78. In some applications, a guide shoe is attached to the bottom of the string to ensure ease of installation into the lower packer 52. Once inserted, seal assembly 102 seals against an inside bore of the lower packer 52. At least a portion of inductive coupler 82 also can be deployed with the electric submersible pumping system string. Depending on local requirements and regulations, the upper packer may comprise a production packer to isolate the casing annulus from pressure. If a production packer is used, it may be a cup-style or hydraulic-set, pull to release packer. (If a hydraulic-set packer is used, a nipple profile can be deployed below the packer to enable setting of the packer by pressurizing the tubing.) Also, a splice can be positioned in the production packer so as to run control line 84 through the production packer.

Figure 4:
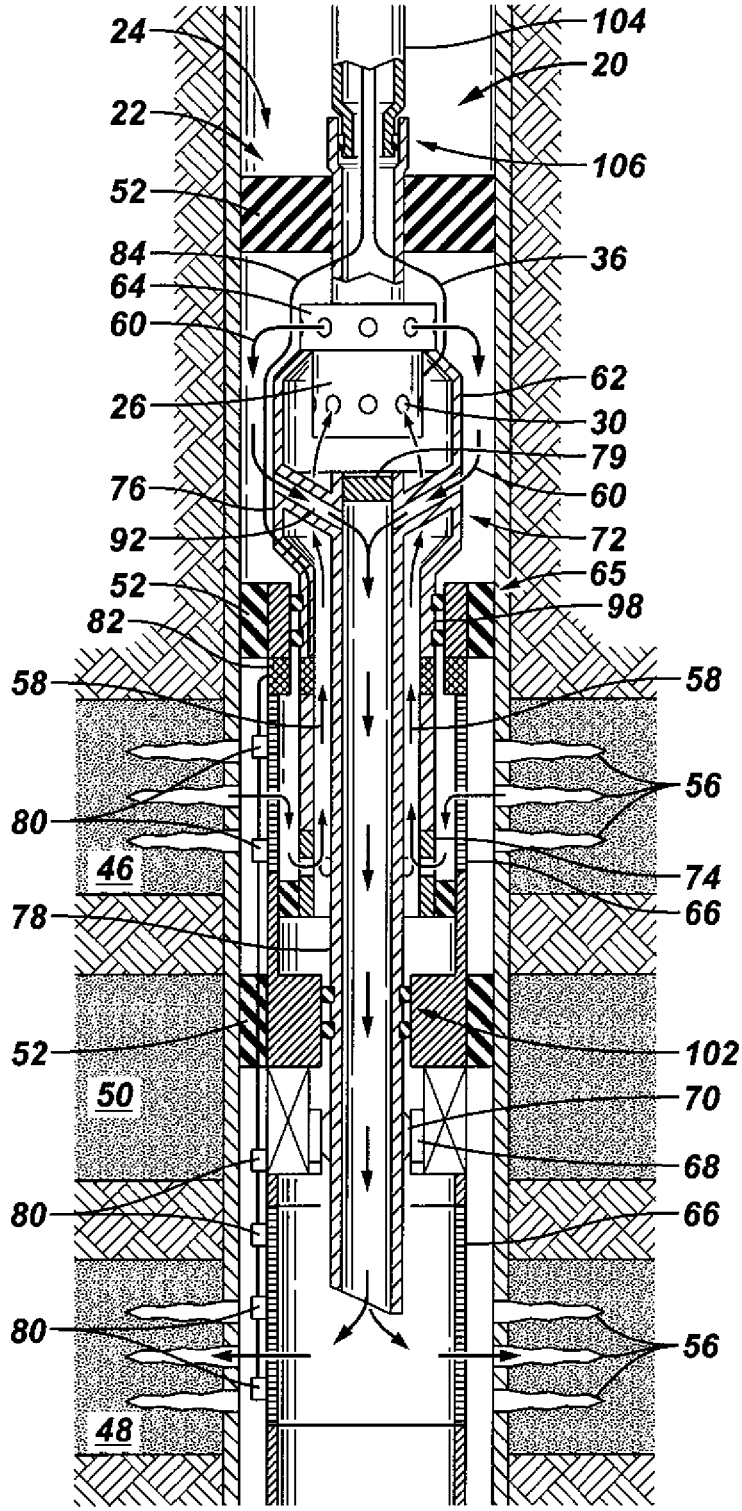
FIG. 4 is a schematic illustration of another example of the injection system illustrated in FIG. 1, according to an alternate embodiment of the present invention.

As described, a variety of components and arrangements of components can be used in system 20. Additionally, the shrouded electric submersible pumping system 26 can be deployed downhole by a variety of conveyance methods. One type of conveyance that facilitates the running and retrieval of electric submersible pumping system 26 and its associated completion components is coiled tubing 104, as illustrated in FIG. 4. In this embodiment, both power cable 36 and control line/cable 84 are run with the coiled tubing 104. For example, the power cable 36 and/or control line 84 can be deployed inside coiled tubing 104 or within a wall of the coiled tubing. A coiled tubing/electric submersible pumping system lower connector 106 is used to connect the coiled tubing with the electric submersible pumping system completion 22. In some applications, the connector 106 can be designed with a hydraulic release.

In addition to optional conveyance methods, system 20 can be deployed in a variety of optional configurations to optimize an injection operation for a given well environment. For example, system 20 can be used with multi-lateral well types in which the upper interval or well zone 46 comprises a junction to a lateral leg that extends into the aquifer. In this embodiment, a lower leg of the multi-lateral well could be utilized as the main bore. In some environments, the water containing aquifer may be at a well zone lower than the injection zone. However, crossover port 76 can be adapted to allow water to be produced from the aquifer, up the isolation tubing 78, and directly into the bottom of shroud 62 (plug 79 is removed). The fluid discharged from submersible pumping system 26 is routed down both the annulus surrounding the shroud and the annulus surrounding the isolation tubing until being directed into the appropriate injection zone.

System 20 also can readily be used with passive flow control devices in the sandface completion 65 or with screen mounted active flow control devices. Additionally, the system 20 is compatible with compartmentalized horizontal wellbores in which swell packers are used in conjunction with screens and passive or active flow control devices that distribute injected fluid along a desired lateral length of the wellbore. These are just a few examples of how system 20 can be adapted for a variety of wells and a variety of environmental conditions.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of injecting water into a well zone, comprising:

deploying a shroud around a non-inverted electric submersible pumping system having a pump intake and a motor positioned below a pump, the shroud creating a first flow path and a second flow path in a wellbore;

drawing water upwardly to the pump intake from a water source zone and along the first flow path via the electric submersible pumping system;

pumping the water back down along the second flow path; and using a crossover port to direct the flow of water to an injection zone.

2. The method as recited in claim 1, wherein using comprises using the crossover port to direct the flow of water to the injection zone at a location below the water source zone.

3. The method as recited in claim 1, wherein using comprises using the crossover port to direct the flow of water to the injection zone located below a hydrocarbon reservoir to increase hydrocarbon recovery.

4. The method as recited in claim 1, further comprising using a seal bore isolation packer to isolate the water source zone from the injection zone along the wellbore.

5. The method as recited in claim 1, further comprising locating an isolation valve below the electric submersible pumping system for selective opening when the electric submersible pumping system is run into the wellbore.

6. The method as recited in claim 1, further comprising monitoring at least one well parameter at multiple points along the wellbore during injection of water into the injection zone.

7. The method as recited in claim 1, further comprising using an inductive coupler to transfer power and communication signals between a plurality of sensors and the electric submersible pumping system completion.

8. The method as recited in claim 1, further comprising introducing a treatment chemical into the water prior to injection of the water into the injection zone.

9. A method, comprising:

using a non-inverted electric submersible pumping system in a wellbore to draw water from a water source zone;

employing a shroud and a crossover port to redirect a flow of the water downwardly along an isolated flow path;

injecting the flow into an injection zone; and drawing water from the water source along an interior of the shroud; and routing fluid pumped by the electric submersible pumping system downwardly along an exterior of the shroud to the crossover port.

10. The method as recited in claim 9, wherein injecting comprises injecting the flow into the injection zone at a location below the water source zone.

11. The method as recited in claim 9, further comprising:

locating the isolated flow path at least in part in a tubing; and drawing water from the water source zone along an annulus around the tubing.

12. The method as recited in claim 9, further comprising isolating zones by deploying a first packer between the electric submersible pumping system and the water source zone and a second packer between the water source zone and the injection zone.

13. The method as recited in claim 9, further comprising utilizing a sand control mechanism in the wellbore at the water source zone.

14. The method as recited in claim 9, further comprising monitoring formation parameters during the injection process.

15. The method as recited in claim 9, further comprising deploying the electric submersible pumping system via coiled tubing.

16. A system, comprising:

an electric submersible pumping system positioned in a wellbore in a non-inverted orientation;

a shroud positioned around the electric submersible pumping system;

a crossover port engaged with the shroud; and a flow tube extending downwardly from the crossover port, wherein the shroud, the crossover port and the flow tube cooperate to create a first isolated flow path, along which water can be drawn from a water source zone, and a second isolated flow path, along which the water is redirected downwardly to an injection zone below the electric submersible pumping system, wherein the first isolated flow path extends along an exterior of the flow tube and an interior of the shroud and the second isolated flow path extends along an exterior of the shroud and downwardly through an interior of the flow tube.

17. The system as recited in claim 16, further comprising a sensor array positioned along the wellbore.

18. The system as recited in claim 16, further comprising a flow isolation valve positioned proximate the lower end of the flow tube.

19. The system as recited in claim 16, further comprising a plurality of packers with at least one packer positioned between the injection zone and the water source zone and at least one other packer positioned between the water source zone and the electric submersible pumping system.

* * * * *